United States Patent [19]

Pettus

[11] Patent Number: 5,074,519

[45] Date of Patent: Dec. 24, 1991

[54] FAIL-CLOSE HYDRAULICALLY ACTUATED CONTROL CHOKE

[75] Inventor: Ronald G. Pettus, Houston, Tex.

[73] Assignee: Cooper Industries, Inc., Houston, Tex.

[21] Appl. No.: 612,889

[22] Filed: Nov. 9, 1990

[51] Int. Cl.[5] ..... F16K 31/143

[52] U.S. Cl. ..... 251/14; 74/424.8 VA; 74/625; 137/375; 137/625.3; 137/625.38; 166/91; 251/63.5; 251/63.6; 251/120; 251/229; 251/325; 251/330

[58] Field of Search ..... 74/424.8 VA, 625; 137/312, 375, 454.2, 454.5, 454.6, 625.3, 625.37, 625.38; 166/91; 251/14, 120, 205, 229, 282, 324, 325, 330, 62, 63.5, 63.6

[56] References Cited

U.S. PATENT DOCUMENTS

| | | | |
|---|---|---|---|
| 2,733,041 | 1/1956 | Crookston | 251/14 |
| 3,029,060 | 4/1962 | Anderson | 251/14 |
| 3,378,224 | 4/1968 | Boyle | 251/14 |
| 3,402,912 | 9/1968 | Watkins | 251/14 |
| 3,628,397 | 12/1971 | Sheesley | 74/625 |
| 3,937,247 | 2/1976 | Vander Wal | 251/325 |
| 4,167,262 | 9/1979 | Lemmon | 251/25 |
| 4,194,718 | 3/1980 | Baker et al. | 251/14 |
| 4,213,480 | 7/1980 | Orum et al. | 137/556 |
| 4,230,299 | 10/1980 | Pierce, Jr. | 251/14 |
| 4,240,609 | 12/1980 | Hahn et al. | 251/282 |
| 4,471,810 | 9/1984 | Muchow et al. | 251/282 |
| 4,503,878 | 3/1985 | Taylor | 137/375 |
| 4,650,151 | 3/1987 | McIntyre | 251/14 |
| 4,691,893 | 9/1987 | Akkerman et al. | 251/14 |
| 4,844,407 | 7/1989 | Baker | 251/14 |
| 4,971,099 | 11/1990 | Cyvas | 251/282 |

*Primary Examiner*—George L. Walton

*Attorney, Agent, or Firm*—Jackie Lee Duke; Nelson A. Blish; Alan R. Thiele

[57] ABSTRACT

A fail-close hydraulically actuated control choke includes a choke with inlet and outlet flow passages intersecting in a cylindrical flow chamber. A reverse acting trim configuration which utilizes downstream pressure to assist in closing includes a flow cage with a wear sleeve of tungsten carbide shrink fitted therein is reciprocable within the flow chamber to control flow between the inlet and outlet flow passages. The flow cage is closed at one end with a stem extending therefrom which is reciprocated by a fail-close hydraulic actuator. The hydraulic actuator includes a pressure responsive piston in combination with a torque operated driving mechanism. The driving mechanism is positioned within the piston and includes a traveling nut assembly to allow manual positioning of the stem and flow cage independently of the position of the piston. The pressure responsive piston is double acting with a boost pressure supplied to the closing side of the piston and a signal pressure supplied to the opening side of the piston. A loss of signal pressure causes the boost pressure to shift the piston, stem and cage to a closed position. Restoration of the signal pressure moves the cage to its original flow controlling position without requiring a resetting of the flow cage position. Additionally, should the hydraulic circuits or pressure responsive piston become inoperable, the torque operated driving mechanism can still reposition the cage as needed.

15 Claims, 10 Drawing Sheets

FAIL-CLOSE HYDRAULICALLY ACTUATED CONTROL CHOKE

BACKGROUND

This invention relates to a hydraulically actuated fail-close control choke used in the production of oil and gas wells. Prior control chokes have a flow cage or flow sleeve disposed within a choke body for throttling the flow through the choke to obtain a desired flow rate. Typically these control chokes have used positioning means such as a handwheel operated travelling nut assembly or a hydraulic stepping actuator to control the position of the flow sleeve. In either case, in a sudden emergency when it was imperative to shut off flow through the control choke, valuable time was lost as the travelling nut assembly or stepping actuator took considerable time in closing the control choke. Additionally, often the flow sleeve and control choke were constructed in such a manner to require the positioning means to move the flow sleeve against the pressure in the choke. This arrangement required a larger positioning means thereby adding considerably to the cost of these prior control chokes. The present invention concerns a novel arrangement of flow sleeve and positioning means to reduce the size of the components required and allow an immediate closing of the control choke in emergency situations.

R. R. Crookston U.S. Pat. No. 2,733,041 discloses a plug type valve in which a hydraulically controlled piston in combination with a coil spring biasing means is used to open and close the valve. A handwheel operated stem extends through the piston to allow the plug to be opened or closed independently of the piston.

W. G. Boyle U.S. Pat. No. 3,378,224 is an example of a gate valve with a single acting hydraulic piston cooperating with a spring for reciprocating the gate between open and closed positions. A handwheel operated stem which does not have to overcome the spring load is provided for moving the gate should the piston fail to operate.

J. M. Sheesley U.S. Pat. No. 3,628,397 discloses a valve actuator having a single acting hydraulic piston with a ball nut secured thereto in combination with a spring. A ball shaft is secured to the top of the actuator housing and mounted so its rotation causes movement of the piston and the valve gate which is connected to an extension of the lower portion of the piston.

J. C. Lemmon U.S. Pat. No. 4,167,262 is an example of a pilot actuated valve utilizing a cage with longitudinal slots as the flow controlling member. A partial balancing of the load on the fluid actuator is achieved by allowing the flow to act on the end of the cage. No manual override means is disclosed.

P. R. Orum et al. U.S. Pat. No. 4,213,480 discloses a manual override for a hydraulic actuator of a subsea gate valve. Hydraulic pressure in the actuator normally holds the gate open with a spring therein moving the gate to a closed position in case of malfunction. The override comprises a drive nut threaded onto the valve stem and a drive sleeve telescopically engaging the drive nut and connected by a series of splines. The drive sleeve presents a hex shaped external surface for turning by a wrench. This rotation causes axial movement of the gate when an overriding of the actuator is required.

G. S. Baker U.S. Pat. No. 4,844,407 discloses another override mechanism for a gate valve in which the override stem is threaded through the piston of the hydraulic actuator. A plurality of pins and slots prevent rotary movement of the actuator piston and allow rotation of the override stem to cause movement of the valve gate to an open or closed position independent of the actuator.

SUMMARY

The subject invention relates to a novel fail-close hydraulically actuated control choke which provides a manual means for positioning the flow control cage in a desired manner to set the desired flow rate through the choke. The choke also has a hydraulic actuator mounted in surrounding relationship to the positioning means which will cause the cage to move to a closed position in the event of a loss of signal pressure. Upon restoration of the signal pressure, the flow control cage will return to its previousy set flow controlling position.

In its preferred embodiment, the present invention includes a choke body of conventional configuration with inlet and outlet flow passages intersecting in a central flow chamber. A flow cage is disposed in the flow chamber to control flow between the inlet and outlet flow passages. The flow cage is partially pressure balanced to minimize the load on the actuator. Reciprocation of the flow cage within the flow chamber is controlled by an actuation means which includes a torque operated driving mechanism for manually positioning the flow cage and a pressure responsive piston surrounding the driving mechanism. The pressure responsive piston is double acting with a boost pressure supplied to the closing side of the piston and a signal pressure supplied to the opening side of the piston. A loss of signal pressure causes the boost pressure to shift the piston, stem and cage to a closed position. Restoration of the signal pressure moves the cage to its original flow controlling position without requiring a resetting of the manual positioning means. Additionally, should the hydraulic circuits or pressure responsive piston become inoperable, the torque operated driving means can still reposition the cage as needed.

An object of the present invention is to provide a novel control choke apparatus which allows precise manual positioning of the flow cage and the ability to remotely close the control choke in response to a loss of signal pressure.

Another object of the present invention is to provide a control choke which will return to its original flow controlling position after the signal pressure has been restored without requiring external intervention.

A further object of the present invention is to provide a control choke with reverse acting actuation means and a partially pressure balanced flow cage to minimize the load on the actuator stem.

A still further object of the present invention is to provide a control choke with a reverse acting trim configuration which utilizes the downstream pressure to assist in closing the choke and thereby minimize the size of the actuation means required.

BRIEF DESCRIPTION OF THE DRAWINGS

These and other objects and advantages of the present invention are set forth below and further made clear by reference to the drawings wherein.

DESCRIPTION OF THE PREFERRED EMBODIMENT

Figure 1A:
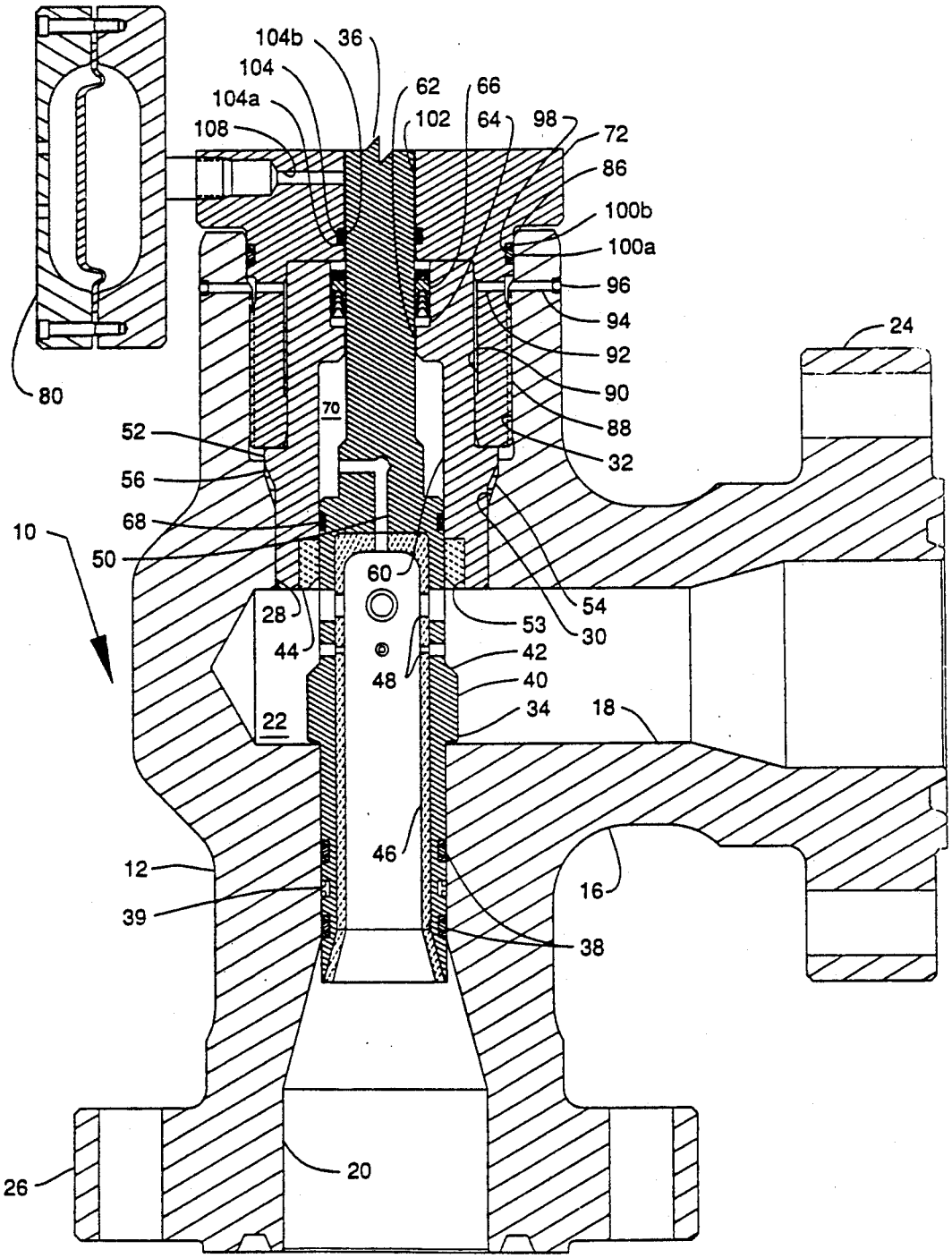
FIGS. 1A and 1B are elevational views, partly in section, of the fail-close hydraulically actuated control choke in an initially open, flow restricting position with signal pressure supplied to the opening side of the actuator with FIG. 1A being the upper portion and FIG. 1B being the lower portion thereof.
Figure 1B:
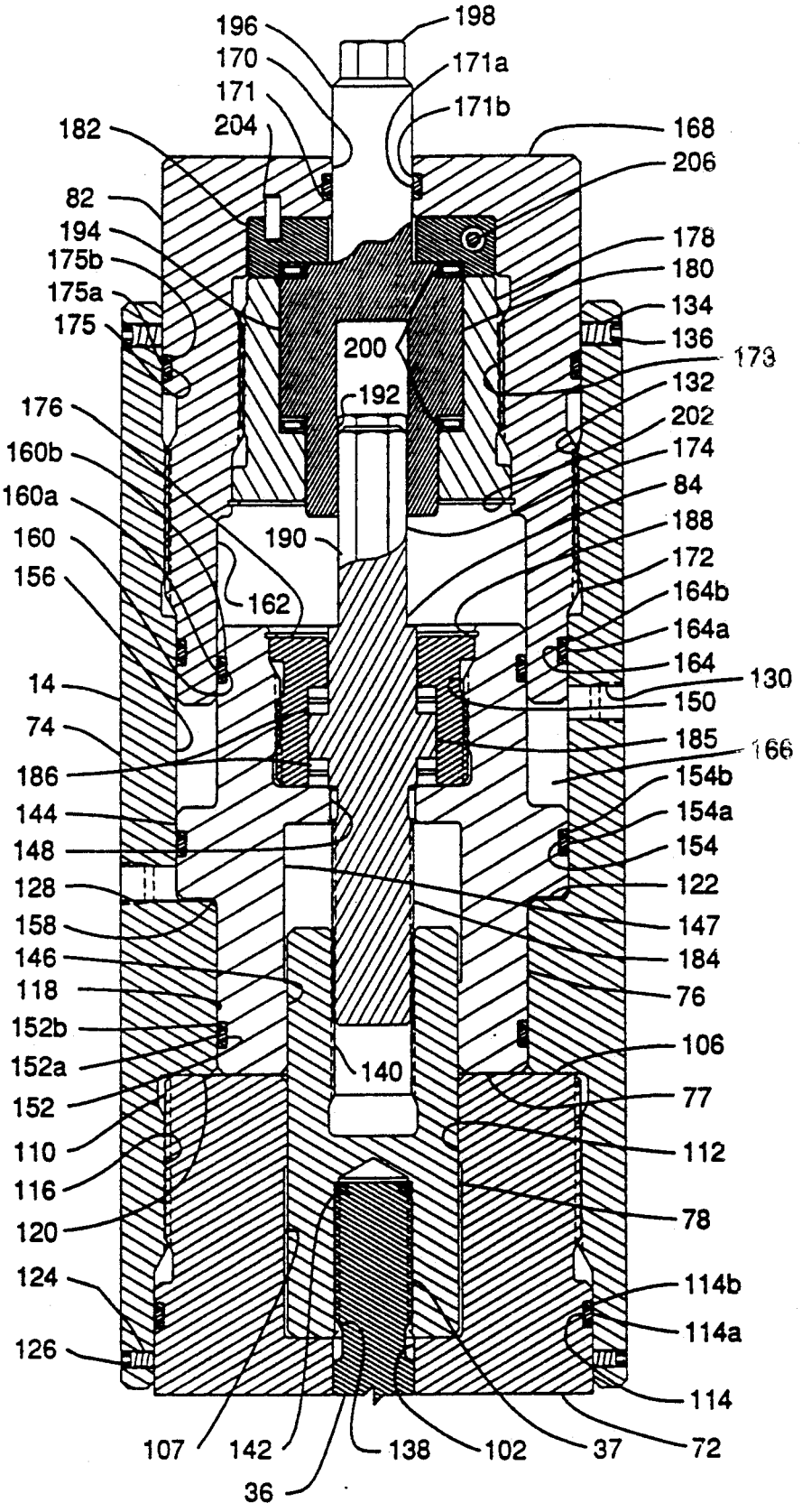

With reference to FIGS. 1 and 1B, the fail-close hydraulically actuated control choke, denoted generally by numeral 10 is composed of choke assembly 12 and actuator assembly 14. Choke assembly 12 is composed of choke body 16 with inlet flow passage 18 and outlet flow passage 20 intersecting therein to form flow chamber 22. Inlet flow passage 18 is provided with flanged connection 24 at its outer end for connection to a flowline, not shown. Similarly, outlet flow passage 20 has flanged connection 26 disposed at its outer end for connection to a flowline, not shown. Actuator passage 28 intersects flow chamber 22 on the opposite side of choke body 16 from outlet flow passage 20 and is coaxial therewith. Actuator passage 28 extends to the exterior of choke body 16 with tapered seal surface 30 located medially therein and internal threads 32 formed at the outer portion thereof.

Flow sleeve 34 is a generally cylindrical member closed on one end with stem 36 extending axially therefrom. Stem 36 has external thread 37 on the outer end thereof for connection to actuator assembly 14. Flow sleeve 34 is reciprocable within flow chamber 22 and outlet flow passage 20 by actuator assembly 14 in a manner to be described hereinafter. Flow sleeve 34 is sealed within outlet flow passage 20 by suitable means as 0 rings 38 and trash seals 39. Flow sleeve 34 has enlarged diameter portion 40 disposed on its exterior with tapered face 42 thereon. Tapered face 42 seals against hardened seat 44 when flow sleeve 34 is in the closed position shown in FIGS. 2A and 2B. Flow sleeve 34 has a wear sleeve 46 of wear resistant material, such as tungsten carbide, shaped to conform to its interior and shrink fitted therein. Flow sleeve 34 has a plurality of radially directed flow apertures 48 of varying diameter disposed therein. Apertures 48 extend through the wall of flow sleeve 34 and wear sleeve 46 and are arranged in pairs of the same diameter on opposite sides of sleeves 34 and 46 in facing relationship. This arrangement of flow passages 48 serves to direct incoming flow streams against one another thereby dissipating their energy and reducing their erosive effects.

Passage 50 provides fluid communication between the interior of flow sleeve 34 and the exterior of stem portion 36 to provide a partial balancing of the pressure load imposed on stem 36. Flow sleeve 34 and stem 36 are surrounded by seat retainer sleeve 52. Sleeve 52 has hardened seat 44 shrink fitted in recess 53 at its innermost end for cooperation with tapered face 42 as previously described. Seat retainer sleeve 52 is closely received within actuator passage 28 with annular metal seal ring 54 disposed in the annulus between exterior seal surface 56 of sleeve 52 and interior seal surface 30 of choke body 16 to provide a metal-to-metal seal therebetween. Seat retainer sleeve 52 has bore 60 extending axially from recess 53 to reduced diameter bore 62 near its outer end, closely fitting about stem portion 36, with recess 64 disposed axially therefrom and facing outwardly. Stem packing assembly 66 is disposed in recess 64 to seal the annulus between stem 36 and recess 64. Flow sleeve 34 has suitable seal means as 0 ring 68 disposed on its exterior which seals within bore 60 of seat retainer sleeve 52. 0 ring 68 and packing 66 seal the annular chamber 70 formed between bore 60 and flow sleeve 34 and stem 36. Passage 50 allows the downstream pressure within flow sleeve 34 to reach chamber 70 and provide a partial balancing of the load on stem 36.

Actuator assembly 14 is composed of bonnet 72, housing 74, piston 76, connecting stem 78, volume compensating chamber 80, end cap 82 and stem drive assembly 84. Bonnet 72 is a generally cylindrical member with reduced diameter end portion 86 having external threads 88 formed thereon and recess 90 therein. Recess 90 closely fits about seat retainer sleeve 52 and retains sleeve 52 within choke body 16 when external threads 88 engage threads 32 of choke body 16 to secure actuator assembly 14 thereto. Ports 92 are radially disposed in bonnet 72 adjacent threads 88 and allow any wellbore fluid that might escape past metal seal 54 or stem packing assembly 66 to be vented radially outwardly through radial ports 94 disposed in choke body 16 and past annularly positioned seal ring 96. Seal groove 98 is displaced axially outwardly from ports 92 with suitable sealing means as O ring **100*a* and antiextrusion rings 100*b*** disposed therein as is well known to those skilled in the art.

Bore 102 extends through bonnet 72 with stem 36 closely received therein. Seal groove 104 is positioned axially outwardly from recess 90 within bore 102 with suitable seal means as O ring **104*a* and antiextrusion rings 104*b* disposed therein. O ring 104*a* and antiextrusion rings 104*b* act as an isolation seal to prevent any wellbore fluid from entering the actuator assembly 14 and contaminating the control fluid therein. Radially directed port 108 communicates bore 102 with volume compensating chamber 80 disposed on the exterior of bonnet 72 to prevent fluid lock of stem 36 when it is reciprocated within bore 102**.

Figure 4:
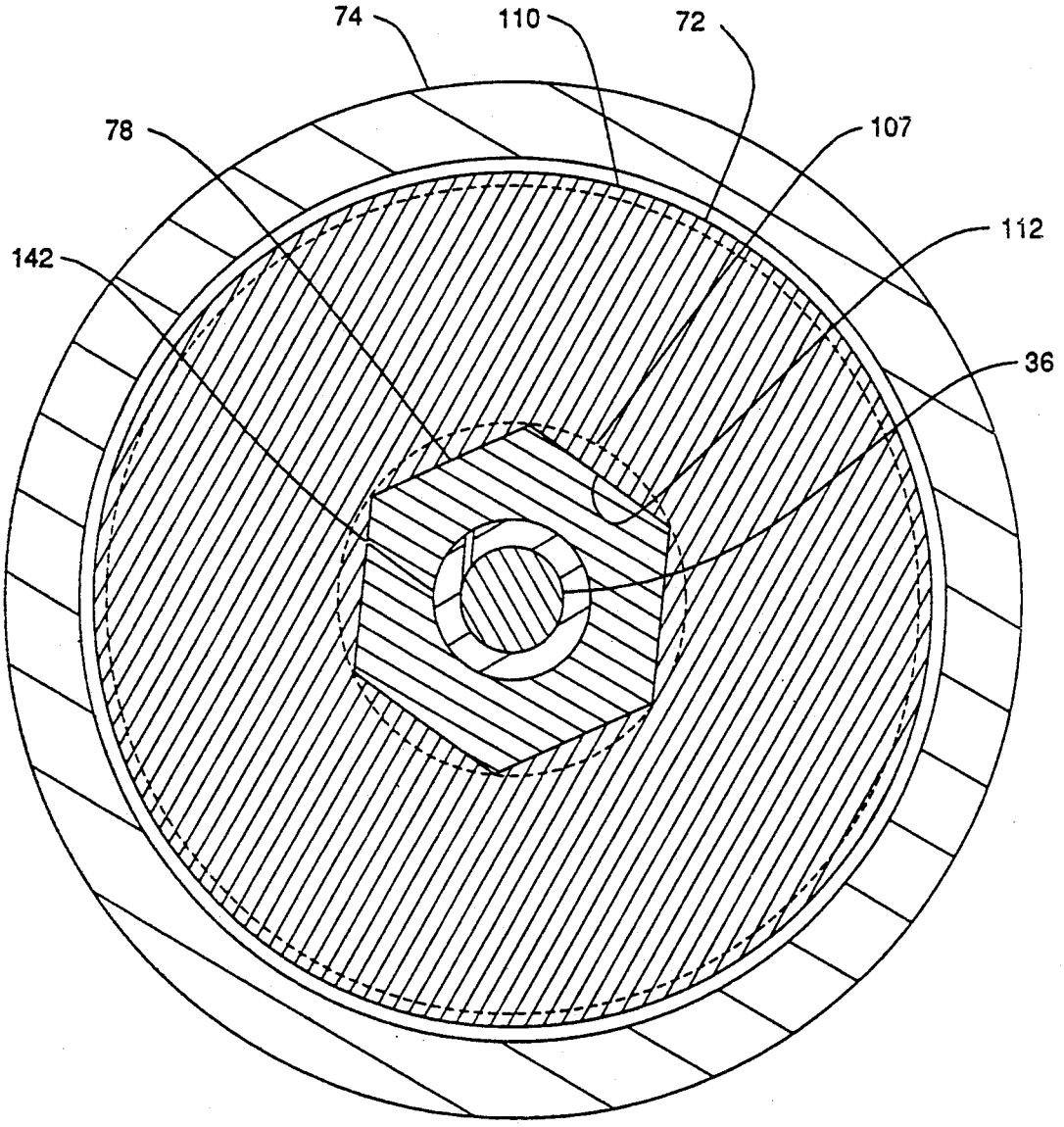
FIG. 4 is a sectional view of the actuation means taken along lines 4—4 of FIG. 2B.

The outer end of bonnet 72 has external threads 110 formed thereon and hexagonally shaped recess 112 extending axially inwardly from end face 106 to bore 107 which circumscribes the hex exterior of connecting stem 78 as best seen in FIG. 4. Seal groove 114 is axially displaced inwardly from threads 110 with O ring **114*a* and antiextrusion rings 114*b* disposed therein. Housing 74 is a generally cylindrical member with internal threads 116 formed on the inner end which engage threads 110 to secure housing 74 on bonnet 72. Reduced diameter bore 118 of housing 74 forms inner shoulder 120 and outer shoulder 122. Inner shoulder 120 abuts the outer end face 106 of bonnet 72 when threads 110 and 116 are fully engaged. Threaded holes 124 are radially disposed at the inner end of housing 74 with socket head set screws 126 therein which engage the outer surface of bonnet 72 to prevent premature disengagement of housing 74 from bonnet 72**.

Radially disposed boost pressure port 128 is located medially in housing 74 with signal pressure port 130 similarly disposed and axially outwardly displaced from port 128 for reciprocating piston 76 in a manner to be described hereinafter. The outer portion of housing 74 has internal threads 132 formed therein with threaded holes 134 radially disposed and axially displaced therefrom. Socket head set screws 136 are threaded therein to prevent premature disengagement of end cap 82 from housing 74.

Connecting stem 78 is hexagonal in cross section as best seen in FIG. 4 with internal thread 138 at its inner end and internal thread 140 at its outer end. Internal thread 138 has lockwasher 142 at its outer end for engagement with the outer end of stem 36 when threads 37 and 138 are engaged. The hexagonal exterior of connecting stem 78 is sliding engaged with hexagonal recess 112 of bonnet 72 and extends within circumscribing bore 107.

Piston 76 is a generally cylindrical member with enlarged diameter outer portion 144, hexagonally shaped recess 146 at its inner end, bore 147 which circumscribes connecting stem 78 when it extends therein, central bore 148 extending therethrough and internal threads 150 formed at the outer end. Seal groove 152 is disposed exteriorly at the inner end of piston 76 with O ring **152*a* and antiextrusion rings 152*b* therein which seal against bore 118 of housing 74. Seal groove 154 is positioned on enlarged diameter portion 144 of piston 76 with O ring 154*a* and antiextrusion rings 154*b* therein which seal against interior surface 156 of housing 74. Sealing means 152 and 154 together define annular chamber 158 therebetween with which boost pressure port 128 communicates. Similarly, seal groove 160 is positioned on the exterior of piston 76 at the outer end with O ring 160*a* and antiextrusion rings 160*b* therein which seal against the interior of recess 162 in bonnet cap 82. End cap 82 has seal groove 164 disposed exteriorly at its inner end with O ring 164*a* and antiextrusion rings 164*b* therein which seal against interior surface 156. Sealing means 160 and 164 in combination with sealing means 154 define annular chamber 166 therebetween with which signal pressure port 130** communicates.

End cap 82 is a generally cylindrical member with radially inwardly turned end flange 168 at the outer end thereof with bore 170 extending therethrough. External threads 172 are disposed on end cap 82 and axially displaced outwardly from seal means 164. Threads 172 engage threads 132 to position and retain stem drive assembly 84 within housing 74. Internal threads 173 are disposed within end cap 82 and axially displaced outwardly from bore 162. Socket head set screws 136 contact the exterior of end cap 82 to prevent premature removal of end cap 82 from housing 84. Bore 170 of end cap 82 has seal groove 171 disposed therein with O ring **171*a* and antiextrusion rings 171*b* positioned therein. Seal groove 175 is disposed exteriorly on end cap 82 and axially outwardly from threads 172 with O ring 175*a* and antiextrusion rings 175*b* therein which seal within housing 74 to exclude contaminating agents from threads 172**.

Stem drive assembly 84 is positioned within piston 76 and end cap 82 and is composed of driving stem 174, retainer collar 176, retainer nut 178, driving nut 180 and clutch 182. Driving stem 174 is a cylindrical member with external thread 184 at its inner end engaging thread 140 of connecting stem 78. Enlarged middle portion 185 of driving stem 174 has thrust bearings 186 positioned on either side and retained within piston 76 by retainer collar 176. Snap ring 188 is positioned within piston 76 to prevent retainer collar 176 disengaging from piston 76. Thrust bearings 186 support driving stem 174 and allow rotation thereof. Driving stem 174 extends axially outwardly from enlarged middle portion 185 with hex cross section portion 190 formed thereon. Hex portion 190 engages mating hex recess 192 formed at the inner face of driving nut 180.

Figure 5:
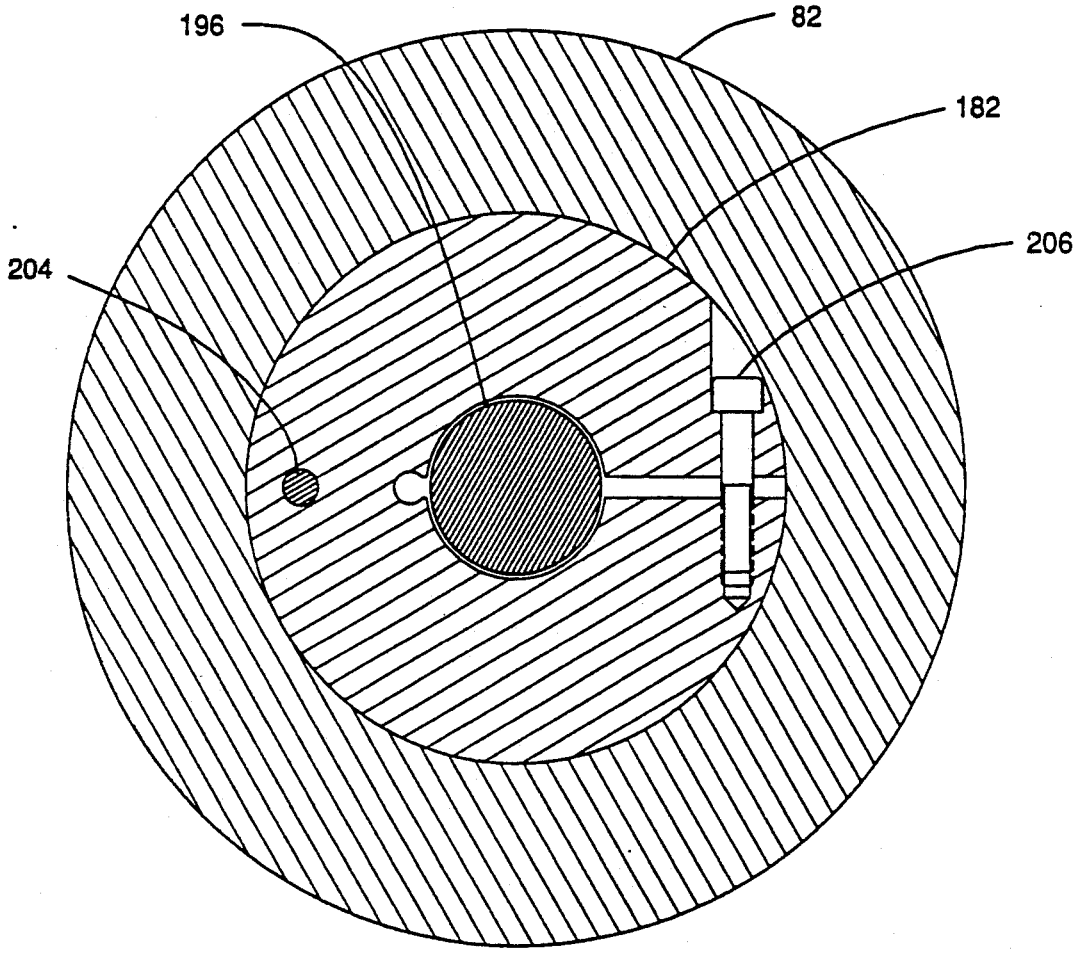
FIG. 5 is a sectional view of the clutch within the actuation means taken along lines 5—5 of FIG. 2B.

Driving nut 180 is a generally cylindrical member with enlarged diameter middle portion 194 having stem 196 extending axially outwardly therefrom with wrenching hex 198 formed thereon. Thrust bearings 200 are positioned on either side of middle portion 194 and held in position within recess 162 of end cap 82 by retainer nut 178 with snap ring 202 preventing driving nut 180 disengaging from end cap 82. Thrust bearings 200 support driving nut 180 and allow rotation thereof. Clutch 182, as seen in in cross section in FIG. 5, is positioned between outer thrust bearing 200 and flange 168 of end cap 82. Clutch 182 is antirotated with respect to end cap 82 by pin 204 and prevents undesired rotation of drive assembly 84 due to vibration when the control choke assembly 10 is in service. Movement of screw 206 allows clutch 182 to be adjusted to obtain the desired degree of friction on stem 196.

A typical sequence of operations for using the fail-close hydraulically actuated control choke begins with connection of inlet and outlet flow lines (not shown) to inlet flow passage 18 and outlet flow passage 20, respectively. Pressurized control fluid, typically 1500 psi, from an accumulator system (not shown) is supplied to signal pressure port 130 while boost pressure port 128 is vented. This shifts piston 76 to the position shown in FIGS. 1A and 1B. Wrenching hex 198 is rotated which in turn rotates driving stem 174 through its coaction with hex recess 192. Driving stem 174 rotates in thrust bearings 186 positioned within piston 76. Piston 76 is antirotated with respect to bonnet 72 by the interaction of hex recess 146 at its inner face, hex recess 112 at the outer face of bonnet 72 and the hexagonal cross section of connecting stem 78 which slides within the two hexagonal recesses. As bonnet 72 is secured to choke body 16, connecting stem 78 can reciprocate but not rotate in hexagonal recesses 112 and 146. This causes threads 184 and 140 to engage and disengage, depending on the direction of rotation of driving stem 174, which allows reciprocation of connecting stem 78 and stem 36 and flow sleeve 34.

Figure 2A:
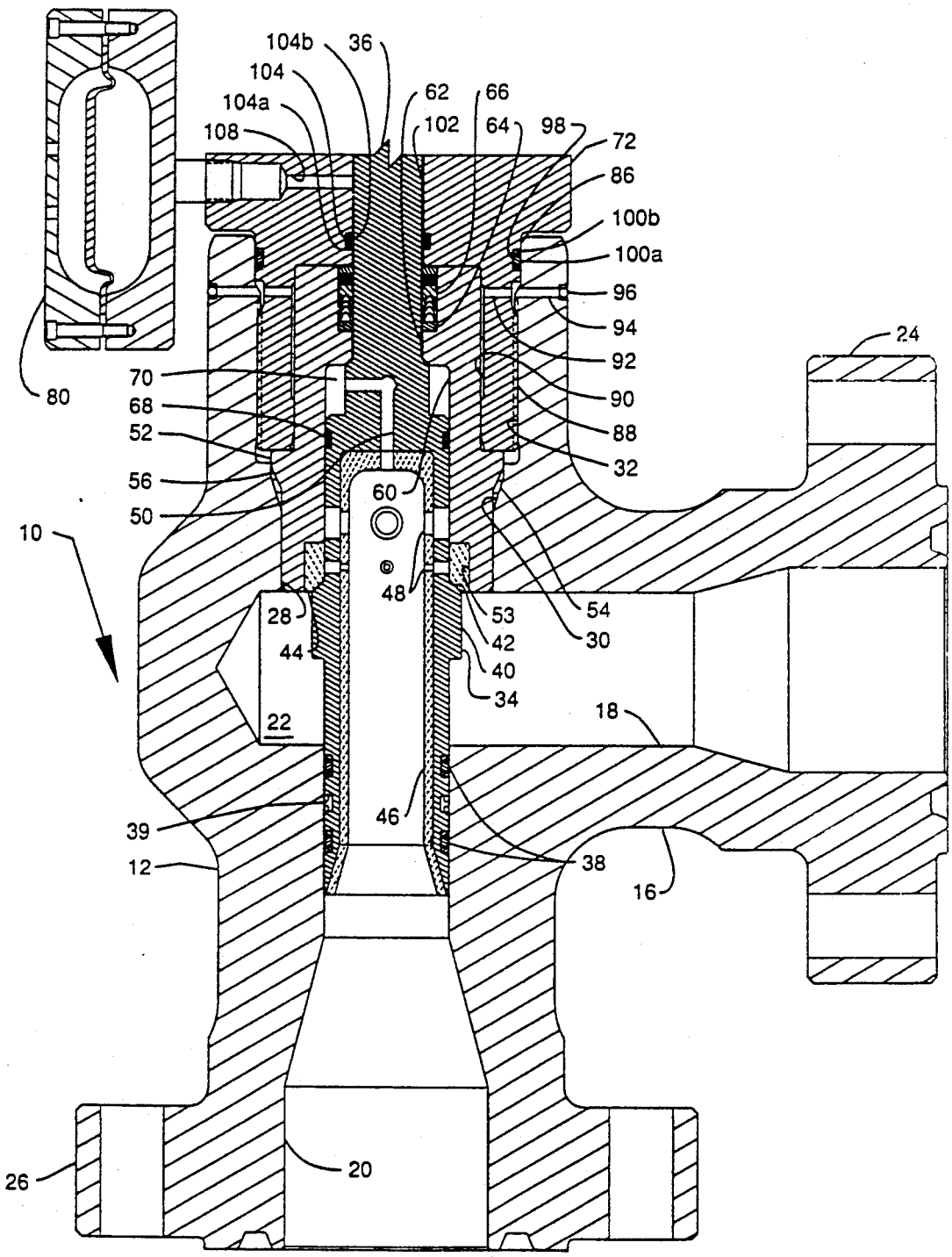
FIGS. 2A and 2B are similar views of the fail-close hydraulically actuated control choke with the manual driving means having moved the flow cage to a closed position while signal pressure is supplied to the opening side of the actuator and boost pressure is supplied to the closing side of the actuator with FIG. 2A being the upper portion and FIG. 2B being the lower portion thereof.
Figure 2B:
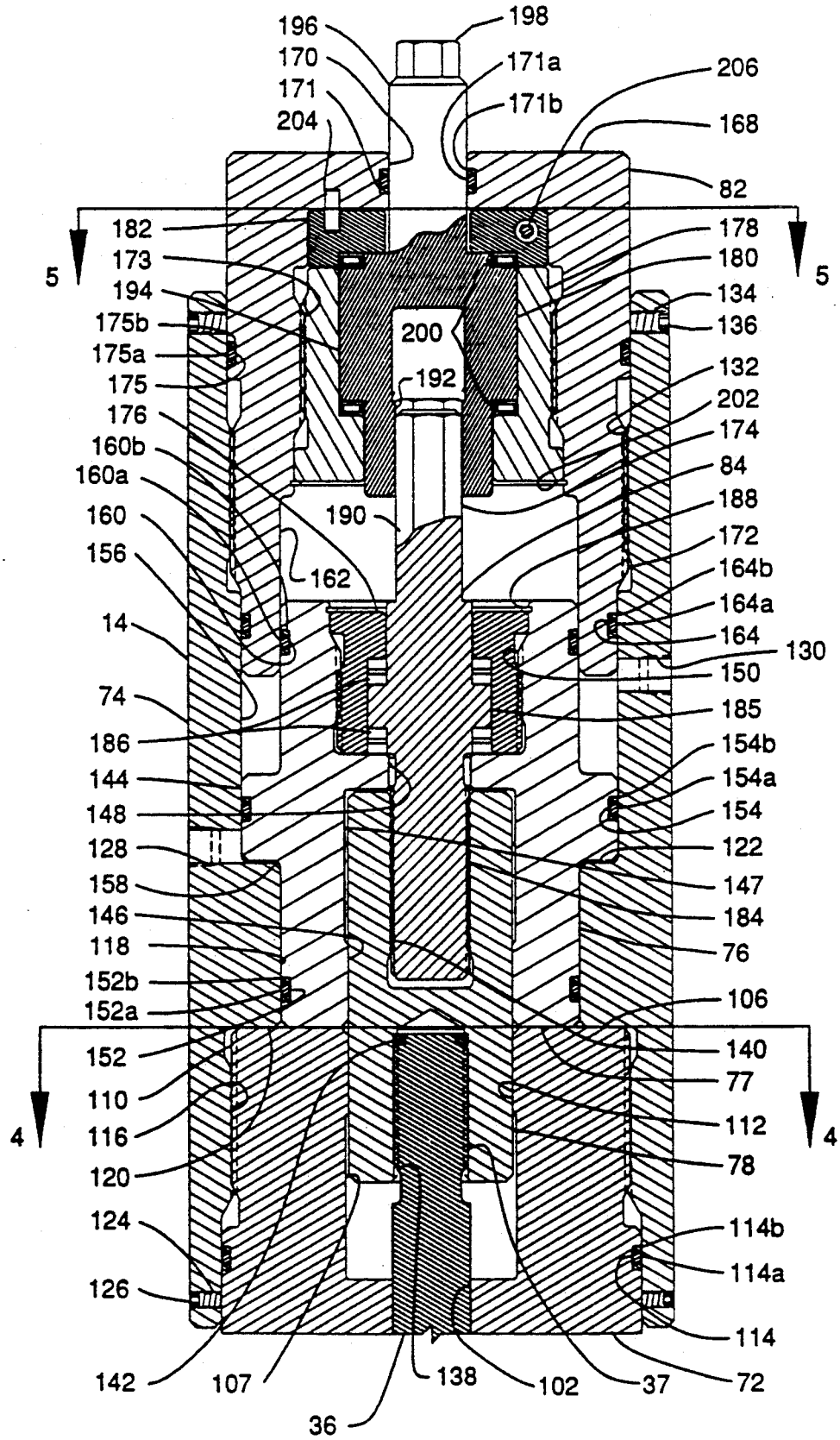

With piston 76 positioned as shown in FIGS. 1A and 1B, wrenching hex 198 is rotated to move flow sleeve 34 as described above to a fully closed position whereby tapered face 42 of flow sleeve 34 is in sealing contact with hardened seat 44 as seen in FIGS. 2A and 2B. Pressurized control fluid, typically 500 psi, is then supplied to boost pressure port 128. Wrenching hex 198 is then rotated to position flow sleeve 34 in the desired flow controlling position. The control choke assembly 10 can then be placed on stream with the produced fluid entering at passage 18 and exiting at passage 20. If a different flow rate is desired, wrenching hex 198 can be turned independently of piston 76 to move flow sleeve 34 and expose more or less of flow passages 48.

Figure 3A:
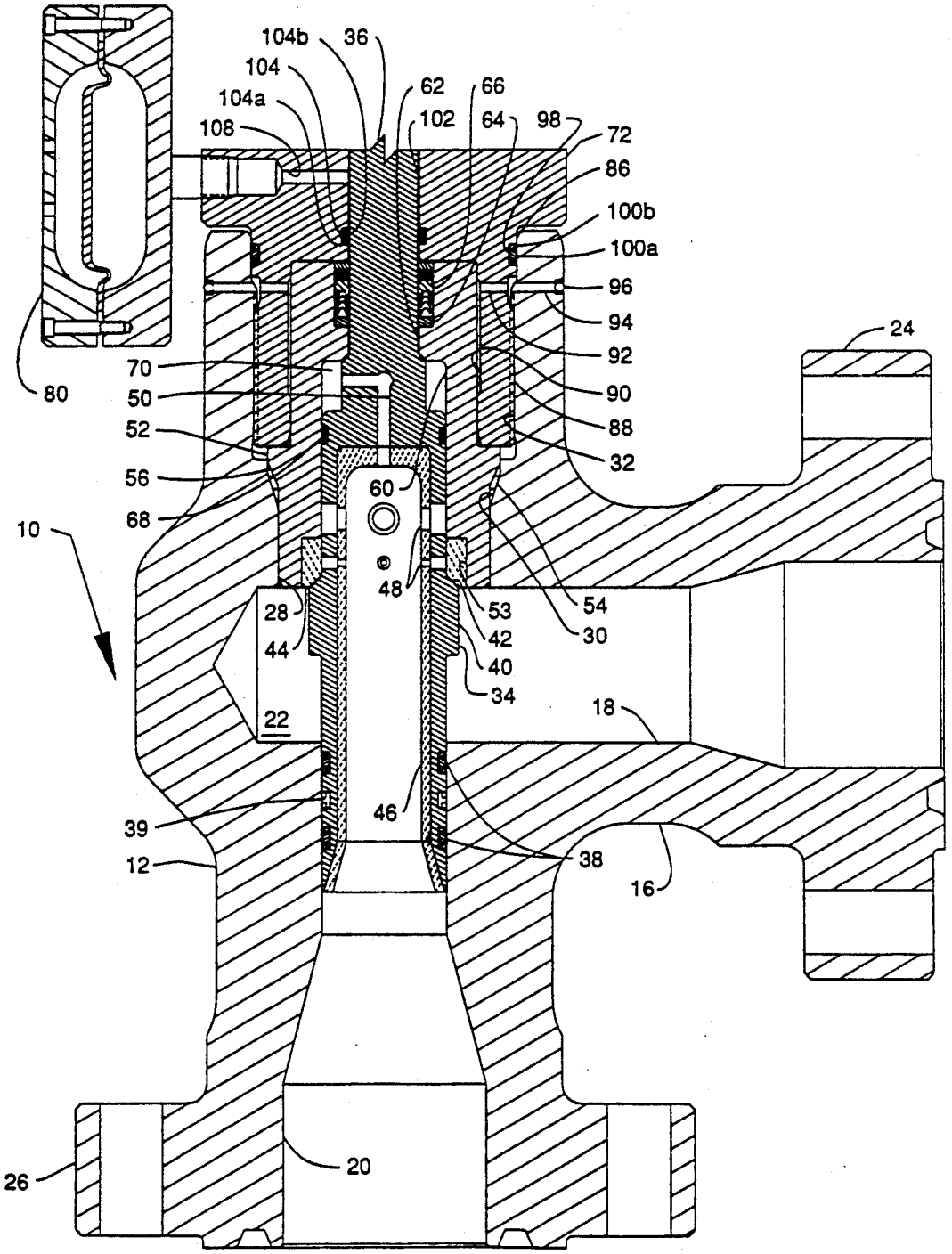
FIGS. 3A and 3B are similar views of the fail-close hydraulically actuated control choke with signal pressure removed and boost pressure having moved the flow cage to a closed position with FIG. 3A being the upper portion and FIG. 3B being the lower portion thereof.
Figure 3B:
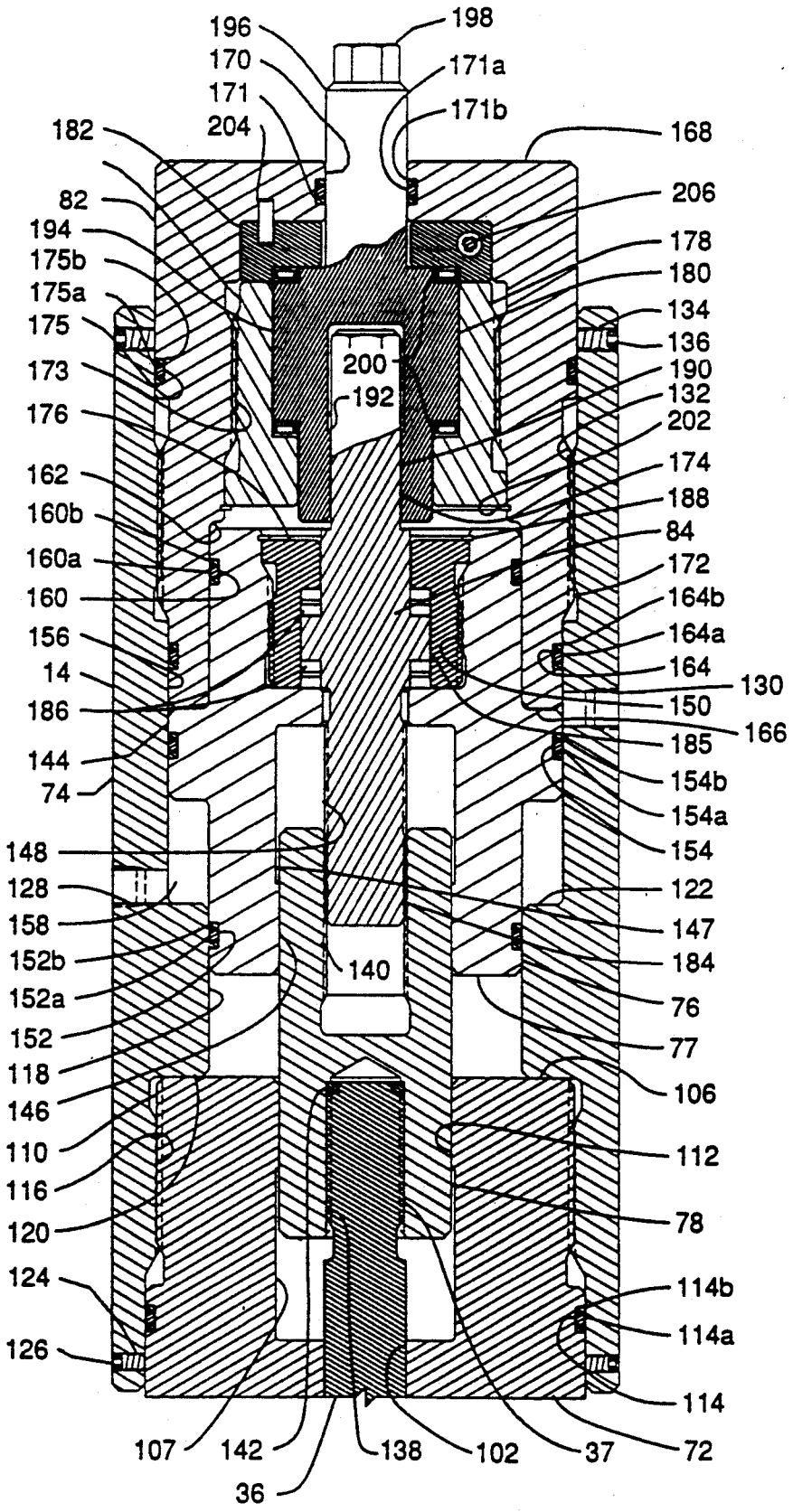
Figure 6A:
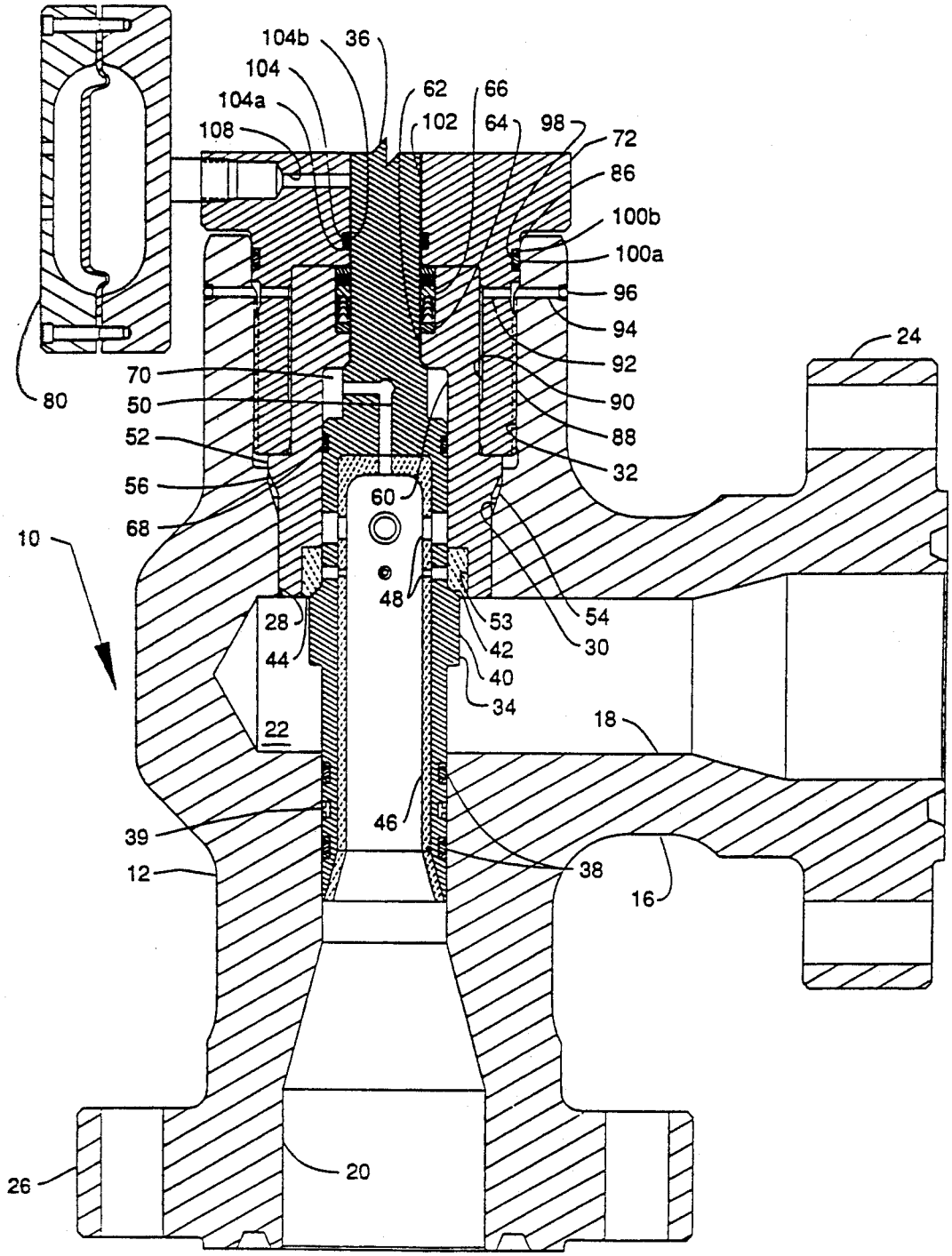
FIGS. 6A and 6B are similar views of the fail-close hydraulically actuated control choke with signal pressure removed and boost pressure and return spring having moved the flow cage to a closed position with FIG. 6A being the upper portion and FIG. 6B being the lower portion thereof.
Figure 6B:
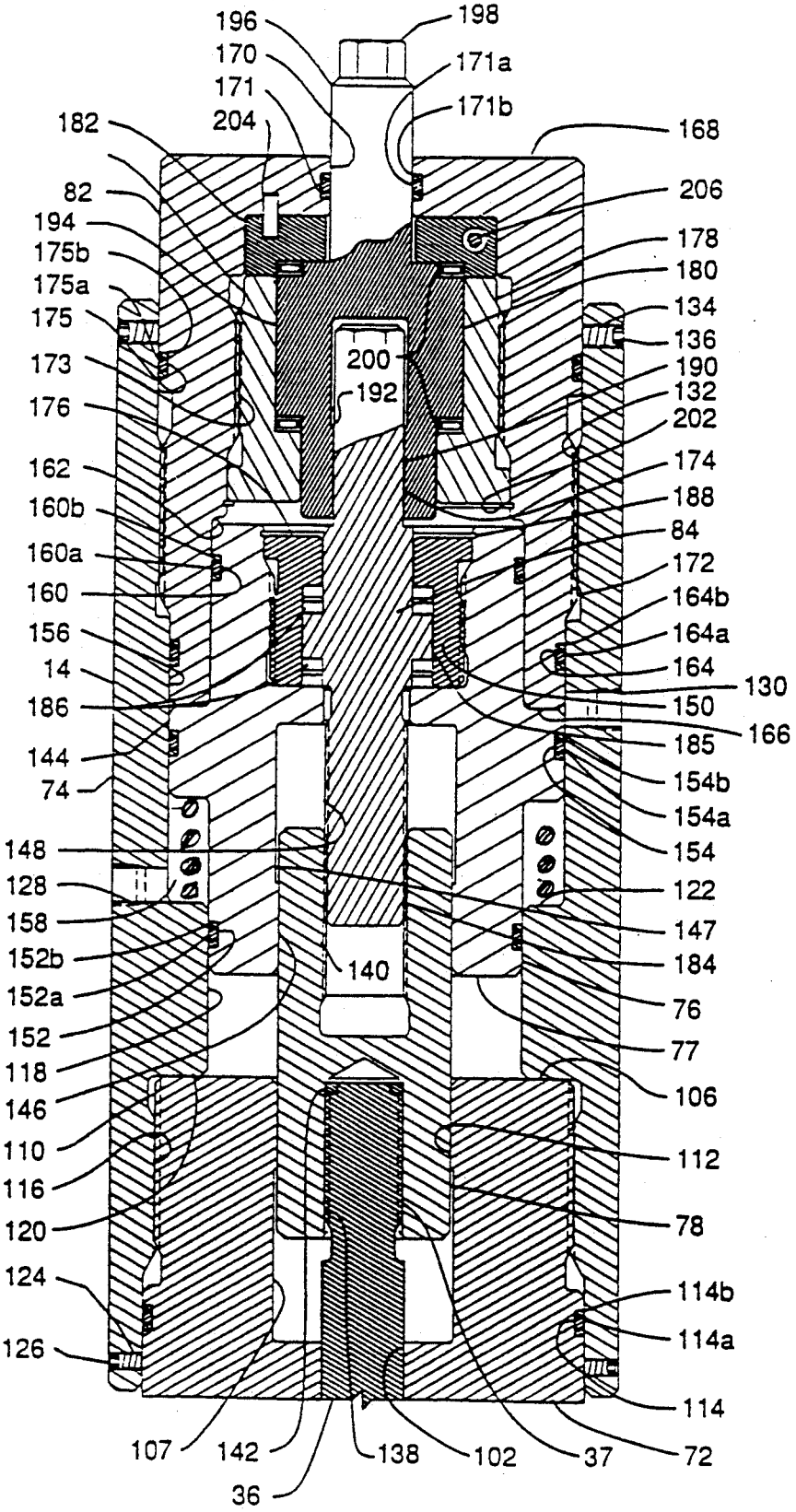

In the event of an emergency, the supply of control fluid to signal pressure port 130 can be vented, allowing the boost pressure in chamber 158 to shift piston 76 and sleeve 34 to a closed position, thereby stopping fluid flow through the choke as seen in FIGS. 3A and 3B. The closing of the control choke is also assisted by the pressure within flow sleeve 34 which acts upon the diameter of stem 36 sealed by stem packing assembly 66 to urge flow sleeve 34 to a fully closed position. It will be obvious to those skilled in the art that an alternative embodiment could include additional urging means such as coiled spring 158*a* shown in FIGS. 6A and 6B to assist the boost pressure in chamber 158 in closing the control choke. Such additional urging means could be interposed between end face 106 of bonnet 72 and end face 77 of piston 76 to provide additional force for closing the control choke while requiring only slight elongation of housing 74 and connecting stem 78. After the emergency has passed, pressurized fluid is supplied to signal pressure port 130 thereby moving flow sleeve 34 to its previous flow controlling position without requiring any manual resetting of the flow sleeve 34, as best seen in FIGS. 1A and 1B.

What is claimed is:

1. A fail-close control choke, comprising:

a pressure containing member having an internal flow chamber with an inlet flow passage thereto and an outlet flow passage therefrom, a flow controlling means sealingly and reciprocably retained within said internal flow chamber to control flow between said inlet and said outlet, a means for positioning said flow controlling means, and a pressure responsive means operatively connected to said positioning means for moving said flow controlling means from a first flow controlling position to a closed position in response to a signal pressure, said positioning means operable through and independently of said pressure responsive means to variably position said flow controlling means in said first flow controlling position without moving said pressure responsive means and irregardless of the position of said pressure responsive means and the signal pressure acting thereon, and said flow controlling means biased toward said closed position by pressure in said outlet flow passage.

2. A fail-close control choke according to claim 1, wherein said flow controlling means includes:

a flow sleeve with a stem integrally formed therewith, a seat retainer sleeve disposed about said flow sleeve, a sealing means disposed in the annulus between said stem and said seat retainer sleeve and permitting reciprocation of said stem therein, and a seal ring sealing between said seat retainer sleeve and the internal flow chamber.

3. A fail-close control choke according to claim 2, wherein said flow controlling means further includes:

a hardened seat positioned in the end of said seat retainer sleeve opposite said stem sealing means, a sealing means on the exterior of said flow sleeve in sealing engagement with said outlet, and said flow sleeve has a larger diameter seal portion which prevents fluid communication between said inlet and said outlet when said seal portion contacts said hardened seat.

4. A fail-close control choke according to claim 3, wherein:

said flow sleeve has a wear sleeve of substantially harder material therein with radially disposed pressure balancing ports providing fluid communication between the interior of said wear sleeve and the exterior of said flow sleeve, a resilient seal disposed on the exterior of said flow sleeve and sealing against the interior of said seat retainer sleeve, a passageway fluidly communicating the interior of said wear sleeve with an annulus between said flow sleeve and said seat retainer sleeve, sealed by said resilient seal disposed on the exterior of said flow sleeve and said sealing means disposed in the annulus between said stem and said seat retainer sleeve to substantially reduce the pressure load on the stem.

5. A fail-close control choke according to claim 4, wherein:

said substantially harder material of said wear sleeve is tungsten carbide.

6. A fail-close control choke according to claim 5, wherein:

said substantially harder material of said hardened seat is tungsten carbide.

7. A fail-close control choke according to claim 2, wherein said means for positioning said flow sleeve includes:

a choke bonnet with a central bore therethrough, secured to said choke housing and retaining said seat retainer sleeve within said pressure containing member, an isolation seal positioned within said central bore and sealingly engaging said stem extending therethrough, an actuator housing sealingly secured to said choke bonnet with said pressure responsive means sealingly and reciprocably positioned within said actuator housing, a driving means secured to said flow sleeve stem and positioned within said pressure responsive means, and an actuator housing end cap sealingly secured to said actuator housing with said driving means extending therethrough.

8. A fail-close control choke according to claim 7, wherein said driving means includes:

a connecting stem secured to said flow sleeve stem, axially movable within said choke bonnet and said pressure responsive means and preventing relative rotation therebetween, a driving stem threadedly connected to said connecting stem and rotatably secured within said pressure responsive means, whereby rotation of said driving stem causes relative axial movement between said connecting stem and said driving stem, a driving nut rotatably secured within said actuator housing end cap and connected to said driving stem to transmit torque therebetween, a friction producing means in surrounding relationship to said driving nut and prevented from rotating with respect to said actuator housing end cap, and said friction producing means preventing vibration induced rotation of said driving nut.

9. A fail-close hydraulically actuated control choke, comprising:

a pressure containing choke body having an inlet flow passage perpendicularly intersected by an outlet flow passage to form a flow chamber therein, a passage extending outwardly from said flow chamber for mounting a choke actuation means opposite said outlet flow passage and coaxial therewith, said choke actuation means sealingly secured to said choke body and extending within said choke actuation means passage, a flow sleeve reciprocable within said flow chamber to control flow between said inlet flow passage and said outlet flow passage, said choke actuation means including a driving means for positioning said flow sleeve and a pressure responsive piston in surrounding relationship to said driving means, said pressure responsive piston operatively connected to said driving means to move said flow sleeve from variable flow restricting positions to a closed position in response to a signal pressure, said driving means operable through said pressure responsive piston and independently of said pressure responsive piston to variably position said flow sleeve in a flow restricting position without moving said pressure responsive piston and irregardless of the position of said pressure responsive piston and the signal pressure acting thereon, an urging means positioned within said actuation means to urge said pressure responsive piston and said flow sleeve to a closed position in the absence of said signal pressure, and said flow sleeve biased toward said closed position by pressure in said outlet flow passage.

10. A fail-close hydraulically actuated control choke according to claim 9, wherein:

said flow sleeve is closed at one end with a stem extending therefrom, a seat retainer sleeve in surrounding relationship to said flow sleeve and said stem, is secured within said choke body by said actuation means, a sealing means is positioned in the interior of said seat retainer sleeve and seals on said stem, a seal ring is positioned on the exterior of said seat retainer sleeve to seal within said flow chamber, and a hardened seat is positioned within a recess in the end of said seat retainer sleeve opposite said stem sealing means.

11. A fail-close hydraulically actuated control choke according to claim 10, wherein:

a seal means is positioned on the exterior of said flow sleeve in sealing engagement with said outlet flow passage, said flow sleeve has a larger diameter seal portion which prevents fluid communication between said inlet and said outlet when said seal portion contacts said hardened seat, said flow sleeve has a wear sleeve of substantially harder material therein with a plurality of radially disposed pressure balancing ports providing fluid communication between the interior of said wear sleeve and the exterior of said flow sleeve, and a passageway fluidly communicating the interior of said wear sleeve with an annulus between said flow sleeve and said seat retainer sleeve to substantially reduce the pressure load on the stem.

12. A fail-close hydraulically actuated control choke according to claim 11, wherein said choke actuation means includes:

an actuator housing, an antirotation means preventing relative rotation between said piston and said actuator housing, and said antirotation means cooperating with said driving means to reciprocate said flow sleeve.

13. A fail-close hydraulically actuated control choke according to claim 12, wherein said choke actuation means further includes:

an end cap sealingly secured to said actuator housing with said driving means extending therethrough, a friction producing means positioned within said end cap and prevented from rotating with respect thereto, and said friction producing means preventing vibration induced rotation of said driving means.

14. A fail-close control choke according to claim 13, wherein:

said substantially harder material of said wear sleeve is tungsten carbide.

15. A fail-close control choke according to claim 14, wherein:

said substantially harder material of said hardened seat is tungsten carbide.

* * * * *